US010888889B2

(12) United States Patent
Brugger

(10) Patent No.: US 10,888,889 B2
(45) Date of Patent: Jan. 12, 2021

(54) SYSTEM HAVING A DOSING DISPENSER FOR DISPENSING PASTY OR VISCOUS MATERIAL

(71) Applicant: Gerhard Brugger, Pflach (AT)

(72) Inventor: Gerhard Brugger, Pflach (AT)

( * ) Notice: Subject to any disclaimer, the term of this patent is extended or adjusted under 35 U.S.C. 154(b) by 54 days.

(21) Appl. No.: 16/382,114

(22) Filed: Apr. 11, 2019

(65) Prior Publication Data

US 2019/0314840 A1 Oct. 17, 2019

(30) Foreign Application Priority Data

Apr. 12, 2018 (DE) ..... 10 2018 108 701

(51) Int. Cl.
*B05B 11/00* (2006.01)
*B65D 83/04* (2006.01)

(52) U.S. Cl.
CPC ..... *B05B 11/0094* (2013.01); *B05B 11/0032* (2013.01); *B65D 83/0409* (2013.01)

(58) Field of Classification Search
CPC ..... B05B 11/0094; B05B 11/0032; B65D 83/0409
USPC ..... 222/321.6
See application file for complete search history.

(56) References Cited

U.S. PATENT DOCUMENTS

| | | | | |
|---|---|---|---|---|
| 5,437,397 | A | 8/1995 | Fuchs | |
| 9,566,820 | B2 | 2/2017 | Flaig | |
| 9,770,736 | B2 | 9/2017 | Brugger | |
| 10,046,348 | B2 | 8/2018 | Brugger | |
| 2013/0144213 | A1 | 6/2013 | Flaig | |
| 2013/0184653 | A1* | 7/2013 | Moller | A61M 5/31558 604/211 |
| 2013/0334257 | A1 | 12/2013 | Brugger | |
| 2015/0018775 | A1* | 1/2015 | Groeschke | A61M 5/31568 604/207 |
| 2015/0073355 | A1* | 3/2015 | Hirschel | A61M 5/3155 604/189 |
| 2016/0144395 | A1* | 5/2016 | Brugger | B05B 11/3008 401/150 |
| 2016/0279653 | A1* | 9/2016 | Brugger | B05B 11/3015 |

FOREIGN PATENT DOCUMENTS

| | | | |
|---|---|---|---|
| DE | 4030531 | A1 | 4/1992 |
| DE | 102006015976 | A1 | 11/2006 |
| DE | 202010011248 | U1 | 10/2011 |
| WO | 2015003762 | A1 | 1/2015 |
| WO | 2015070935 | A1 | 5/2015 |

* cited by examiner

*Primary Examiner* — Jeremy Carroll
(74) *Attorney, Agent, or Firm* — FisherBroyles, LLP; Craig W. Mueller

(57) ABSTRACT

The invention relates to a system having a dosing dispenser for dispensing pasty or viscous material with a housing, a cartridge displaceably accommodated therein and a walking piston accommodated in the cartridge that forms a unit ready for assembly with a shutter button to be arranged at a cartridge end.

20 Claims, 7 Drawing Sheets

SYSTEM HAVING A DOSING DISPENSER FOR DISPENSING PASTY OR VISCOUS MATERIAL

CROSS REFERENCE TO RELATED APPLICATIONS

This application claims the benefit of German Patent Application No. DE102018108701.2 filed Apr. 12, 2018, the entire disclosure of which is incorporated by reference herein.

FIELD OF THE INVENTION

The invention relates to a system having a dosing dispenser for dispensing of pasty or viscous material, such as cosmetic creams, adhesives, and the like and a corresponding prefabricated assembly unit for the introduction of the dispenser into a cartridge after filling the same with material to be discharged via the applicator and the like.

BACKGROUND AND SUMMARY OF THE INVENTION

Corresponding dosing dispensers are known in the prior art, for example WO 2015/070935 A1. These dosing dispensers are formed as a rule from an elongated, pin-like housing in which a longitudinal, displaceably arranged cartridge is accommodated within the housing. In addition, an applicator is provided for dispensing the material accommodated in the cartridge where a pump unit is provided between applicator and cartridge. If the cartridge is adjusted or displaced, respectively, relative to the pump unit, the pump is actuated and material from the cartridge is guided in a known manner via the applicator to the outside for the purpose of applying a cosmetic cream, for example. In the prior art the displacement of the cartridge for the purpose of a pump stroke can be made in a different manner, either via an actuator shaped as a slide displaceably arranged at a peripheral wall of the housing or by a push button arranged opposite the applicator and maintained relative displaceable within the housing and thus displaces the cartridge by appropriate pressurization via the thumb in direction of the pump unit such that a pump stroke takes place.

In these dosing dispensers, after introduction of the material in the cartridge, the end of the cartridge facing away from the pump is sealed, which is done by introducing a piston, namely a so-called walking piston which is in sealing contact at the inner wall of the cartridge and migrates with progressive emptying of the material from the cartridge with the decreasing material column in the cartridge. On the one hand, this piston is to be generally inserted into the cartridge after introducing the material into it in order to accomplish a sealing of the cartridge interior to the outside and also to prevent the ingress of air. To this end, it is known to provide a locking ball at the piston that seals an opening in the piston through which air may escape downward when introducing the piston at the lower end of the material column. This is important because a retention of air may lead to oxidation of the material filled in the cartridge and thereby to a deterioration of the quality of the material. An air cushion building up in the cartridge would also be detrimental to the dispensing behavior.

The introduction of the piston takes place here automatically for which, however, various workstations are required. Firstly, the piston must be inserted into the cartridge and then the locking ball must be disposed into a piston sleeve mostly formed on the piston crown, and subsequently the shutter button must be disposed for locking the lower housing end and finally inserted requiring several workstations and thereby making the product, i.e. the dosing dispenser, more expensive in terms of manufacture. This is very detrimental because, as a rule, the dosing dispenser concerns a cheap mass product which is extremely low-priced, such that the expenditure for the manufacture of such dosing dispensers must be kept as minimal as possible in order to provide a market acceptance for them.

In addition, when introducing prescribed filling amounts into the cartridge by means of a known filling head, the filling amount introduced never remains the same despite a preset filling amount but varies between limits, i.e. the dosing dispenser or the cartridge, respectively, may have a minimum, a maximum or a mean filling volume, which is why it is also important, to bring the piston mechanically to the correct position at the lower end of the material column within the cartridge. These variations of the filling volume may be caused due to tolerances and may originate from variations of temperature, batches of material and the like.

It is the object of the invention to provide a system having a dosing dispenser and a walking piston making possible the manufacture of such a dosing dispenser especially also in light of possible variations of the filling volume of the cartridge in a simple and rapid manner, making possible a particularly simple and rapid mechanical production.

According to the invention this is achieved by the features included in the characterizing part of claim 1, wherein developments of the invention are characterized by the features included in the dependent claims.

According to the invention the system has a dosing dispenser the cartridge of which is closed by a prefabricated assembly unit subsequent to the filling operation. The assembly unit is formed from a shutter button and a piston arranged thereon such that the piston can be inserted into the cartridge via this pre-assembled assembly unit in one operation. Here, the piston in this assembly unit is axially disposed, projecting opposite the shutter button, and the piston is also relatively displaceably guided opposite the shutter button in such a way that no relative displacement takes place between shutter button and projecting piston as long as the piston, during insertion of the assembly unit into the cartridge, is not yet in abutment at the lower end of the material column filled in the cartridge. Only when the piston abuts at the lower end of the material column and is stopped therewith in its insertion movement, the relative displacement between shutter button and piston takes place so to speak auto search, such that the shutter button can be transferred to its latching position in the cartridge. Thus, all that is needed is one operation in order to introduce the walking piston with its components properly into the cartridge.

In an advantageous embodiment of the invention, the shutter button has a central punch that inserts in pre-assembled position into the piston sleeve, wherein the locking ball is provided between punch and piston in the piston sleeve. The locking ball is displaced with a portion of the punch that is inserted into the piston sleeve after completing the advancing piston is stopped at the material column. Here, the frictional interaction between the piston outer surface and the inner wall of the cartridge is less than the frictional interaction between piston sleeve and inserted punch. This aspect is advantageous because it is ensured that the piston in its axial advanced mounting position is guided to its stopping position at the lower end of the column without relative movement between the shutter button and the piston. More specifically, relative displacement between shutter button and piston starts and takes place when motion of the piston is stopped at the material column. Motion of the shutter button relative to the piston moves the locking ball to its sealing position within the piston sleeve. Thus, the assembly is reduced to one operation.

The piston sleeve of the piston includes an internal volume that operatively accepts a portion of the punch. The internal volume of the sleeve also accommodates the locking ball, which is able to move into a sealing position due to the relative displacement between shutter button or punch of the shutter button, respectively, and the piston, wherein a material passage of the cartridge is blocked, and wherein air escape about the locking ball is prevented. This ensures that after filling of the cartridge no air remains in the filled cartridge and, therefore, harmful effects by oxidation and the like are excluded.

The sealing portion is formed from a first longitudinal portion of the piston sleeve having a reduced sleeve diameter with respect to a remaining diameter of the piston sleeve, at which a second longitudinal portion having a larger diameter portion connects to the side of the shutter button. In this context it is convenient, that an undersize is se between the inner wall of the piston sleeve in the first longitudinal portion and the diameter of the locking ball, in particular from 0.05 mm to 0.2 mm, which specifies the sealing position, where in the second longitudinal portion an oversize of particularly 0.03 mm to 0.1 mm is provided facilitating the relative displacement between shutter button and piston and also allowing for proper air discharge.

Regarding the adjustment of the friction fit mentioned above, a third longitudinal portion is provided at the piston sleeve that is located with respect to the assembly unit in the direction of the shutter button upstream of the first and second longitudinal portion, that is it connects at the second longitudinal portion away from the piston. For this third longitudinal portion, a friction force is adjusted in conjunction with the punch of the shutter button cooperating therewith by material selection, diameter setting and/or roughness setting of the corresponding surfaces, where the friction force only then allows for a relative displacement between piston sleeve and punch when the piston abuts at the material column within the cartridge. However, the friction force may also not be too high, which otherwise would in turn have a disruptive effect. Accordingly, this results in the following ranges for an appropriate setting, i.e. RK(N)/piston surface ($cm^2$), where the ratio is in the range between 1 to max. 5, preferably from 1 to 3. In such a setting, ideal ratios result for the sequence during assembly of the assembly unit. Here, RK stands for friction force measured in Newton.

The transition region between the two longitudinal portions is formed by a conical transition shoulder, in which recesses are distributed in particular in the manner of slots across the periphery, that allow for a proper air passage for the discharge of air from the cartridge. In this context it is also convenient, when the punch has a profile cross-section, and that at least in its longitudinal front portion, which has radial webs forming passages between them for the discharge of compressed air.

In a particularly advantageous embodiment, the piston has a cap-shaped piston head at the free end of the piston sleeve that is preferably rounded at the peripheral edge across the entire periphery. This makes possible, on the one hand, an easy insertion of the assembly unit into the cartridge and makes the desired friction fit easier, which is set smaller than the friction fit between punch and piston sleeve. The rounded peripheral edge is formed with slots for the formation of passage channels, whereby a proper air discharge also takes place in the edge region, even if the opening, centrally provided at the piston cap, would be blocked by the material column.

The invention further relates to a prefabricated assembly unit formed from shutter button and piston, wherein the shutter button is provided with a central punch that engages with a piston sleeve formed in the rear at the piston, wherein the piston is positioned in pre-assembled position in an axially disengaged position opposite the shutter button. Only when the piston, introduced with the assembly unit into the cartridge, abuts at the lower end of the material column located in the cartridge, the shutter button goes further with the introduction of the assembly unit in that the punch goes into the piston sleeve and the locking ball, accommodated between the punch end and the piston in the piston sleeve, moves therewith into the sealing stage.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. Embodiments of the present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF DRAWINGS

The accompanying drawings, which are incorporated in and constitute a part of the specification, illustrate embodiments of the invention and together with the general description of the invention given above and the detailed description of the drawings given below, serve to explain the principles of these inventions.

It should be understood that the drawings are not necessarily to scale. In certain instances, details which are not necessary for an understanding of the invention or which render other details difficult to perceive may have been omitted. It should be understood, of course, that the invention is not necessarily limited to the particular embodiments illustrated herein.

DETAILED DESCRIPTION

Figure 1:
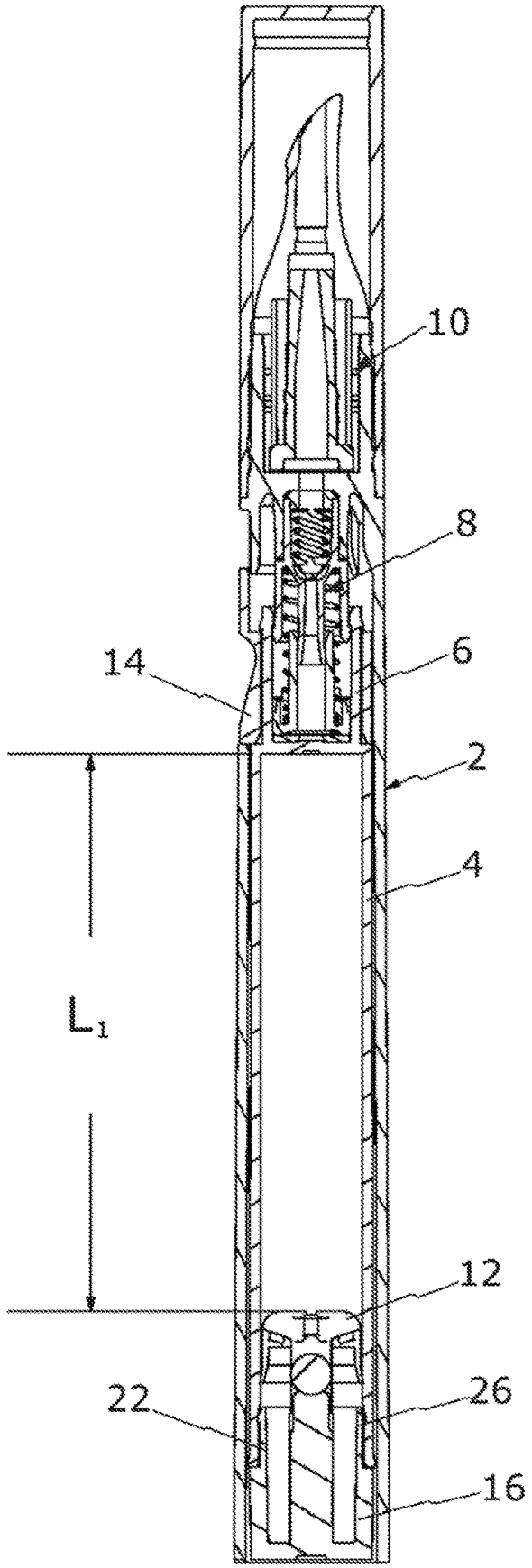
FIG. 1 is a sectional view of a dosing dispenser in one position of an assembly unit to be disposed in the cartridge.
Figure 2:
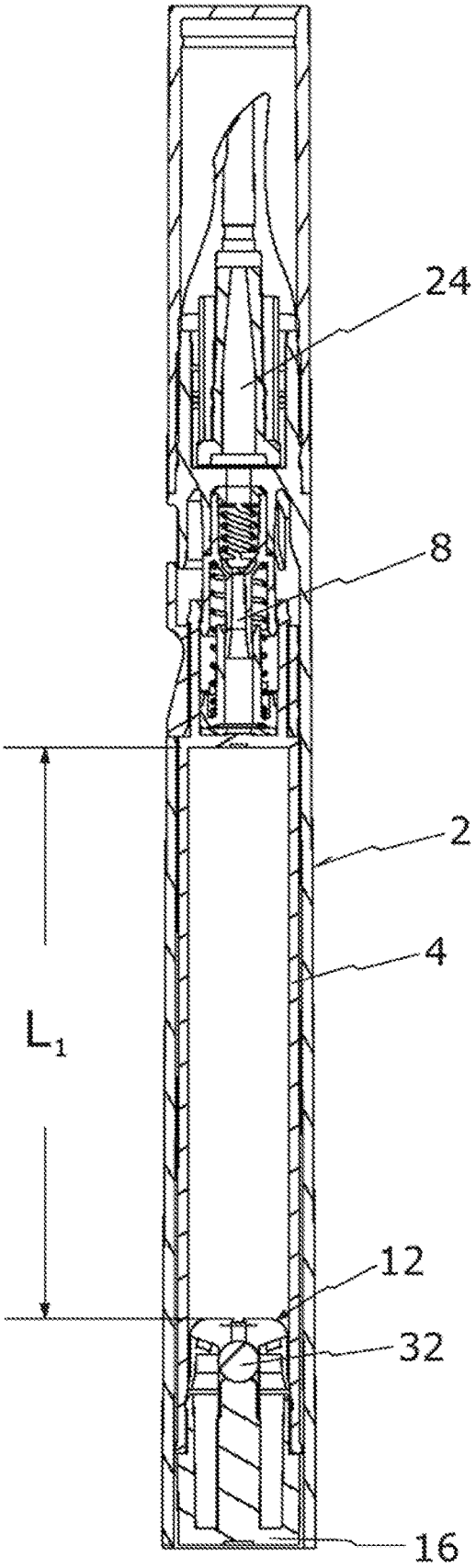
FIG. 2 is a sectional view of a dosing dispenser in one position of an assembly unit to be disposed in the cartridge.
Figure 3:
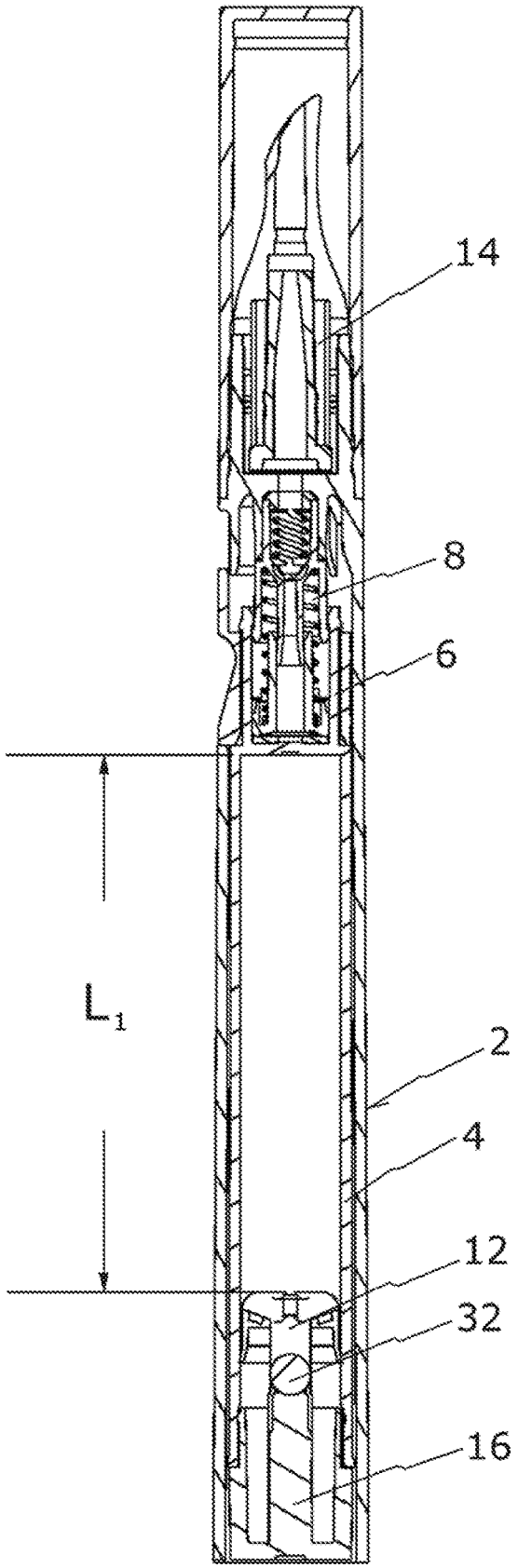
FIG. 3 is a sectional view of a dosing dispenser in one position of an assembly unit to be disposed in the cartridge.

FIGS. 1 to 3 show an inventively equipped dosing dispenser formed from an elongated pin-like housing 2, a cartridge 4 displaceably accommodated therein formed using a preset cartridge sleeve 6, in the region of which a pump unit generally denoted by 8 is accommodated or arranged, respectively, above which a conventional applicator 10 serves to dispense material accommodated in the particularly cylinder-shaped cartridge 4.

At the lower end of the cartridge 4, a piston 12 is inserted into the cartridge 4 that represents a walking piston in a known manner, that migrates or moves upwards, respectively, with increasing emptying of the cartridge contents due to negative pressure and is always here in abutment at the material column located at the lower end of the cartridge 4.

In the embodiment of a dosing dispenser shown in FIGS. 1 to 3, the actuation of the exemplified pump takes place only via a slide 14 arranged in the area of the cartridge sleeve 6. If the slide is manually moved upward, the cartridge 4 is then moved together upwards against the pump unit 8, where the piston of the pump unit is inserted into a cylinder chamber located within the cartridge sleeve 6. A material already located in the cylinder chamber is ejected upwards toward the applicator and to the outside. As an alternative to a slide 14 in the area of the cartridge sleeve 6 for the pump actuation, a push button can also be arranged at the lower end of the housing, which in this case would be accommodated in the housing in a limited displaceable manner such that with actuation of the push button the cartridge 4 is moved upwards against the pump unit and whereby material from the cartridge 4 is accordingly discharged again via the applicator 10 to the outside. The invention described in the following is applicable to both types of dosing dispensers. However, for the purpose of further explanation of the invention the description is made by using the slide 14 apparent from FIGS. 1 to 3 which is displaceably accommodated in the housing 2 in the area the cartridge sleeve 6. This construction of dosing dispensers is known per se, wherein for push button actuation reference can be made to the dosing dispenser according to WO 2015/070935 and with respect to the dosing dispenser equipped with a slide reference can be made to the WO 2015/003762, for example. Construction and operation of the walking piston in the prior art results, for example, from the DE 20 2010 011 248 U1, such that the basic construction of the dosing dispenser does not have to be described here in detail also with respect to the operation, instead reference can be made to the named prior art here. This also applies to the pump since each suitable pump is useful for the invention.

Here, it must be said in advance that FIGS. 1 to 3 show dosing dispensers in which the filling amounts due to inaccuracies of the filling heads used for charging the cartridge or divergent material and temperature conditions and the like are different, namely within certain limits, can be determined by experiments. That is, even if one and the same dosing dispenser is to be charged with a predetermined quantity of material, because of previously mentioned circumstances, deviations of the filling contents and therewith different columns of material result after the first filling operation. FIG. 1 shows a dosing dispenser filled with a filling of medium volume, FIG. 2 shows a dosing dispenser filled with a maximum filling amount, and FIG. 3 shows a dosing dispenser filled with a minimum filling amount. As a result, this is shown by the different length, denoted in FIGS. 1 to 3 by $L_1$, of the material column located in the cartridge 4 where the piston 12 is always in its initial position here, i.e. in the position in which the advanced piston has been led to the lower end of the material column after filling the cartridge as far as to the stop.

The insertion of the piston 12 after filling a cartridge 4 with the material to be discharged takes place generally at different workstations, i.e. first of all threading or inserting, respectively, of the piston 12 in the cartridge, introduction of the known locking ball as well as application of a shutter button 16 in order to close the pin-like housing 2 and the cartridge 4 at the lower end. As stated already in the introduction, a dosing dispenser is formed in FIGS. 1 to 3 having an actuator formed in the area of the cartridge sleeve 6 for the displacement of the cartridge 4 against the pump unit 8 in Form of a slide 14, where, however, a push button formed at the lower end, i.e. at the shutter button 16, could be provided as an alternative just as well as actuator which is then appropriately displaceably arranged in the housing between a start and end position and the cartridge 4 is just as well movable about this against the pump unit 8.

Within the scope of the invention, the shutter button 16 is formed with the piston 12 as an assembly unit ready for installation, as will be explained in detail with the other figures. The pre-assembled assembly unit can be inserted into the cartridge in one operation such that the different workstations required in the prior art including the relocation of the cartridge in the different stations may be omitted, resulting in substantial cost advantages and may be of material advantage for the market acceptance within the context of mass production of such dosing dispensers.

Figure 4:
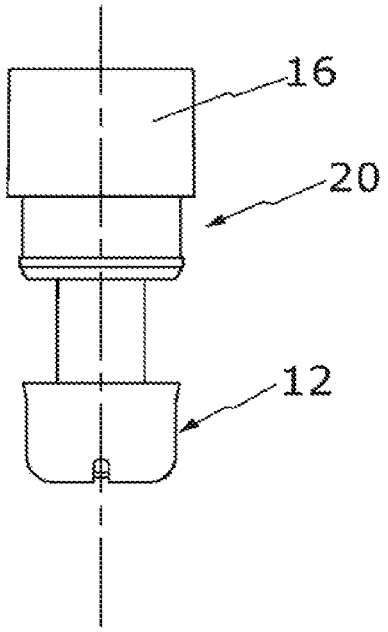
FIG. 4 a side view of the assembly unit.
Figure 5:
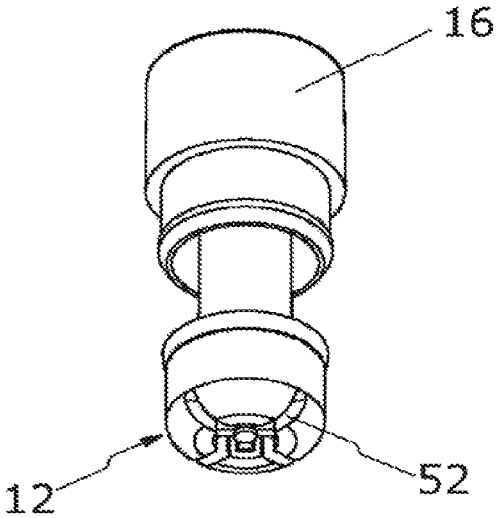
FIG. 5 a perspective representation of the assembly unit.

FIG. 4 shows a side view of the pre-assembled assembly unit for the insertion into a cartridge, wherein the assembly unit 20 in FIG. 5 is shown in perspective representation. As can be seen from FIGS. 4, 5 and 6, in this pre-assembled mounting position the piston 12 is axially advanced against the shutter button 16 from its front end and spaced apart from the shutter button. In this position, the assembly unit 20 is introduced into the cartridge 4 after filling the same. The shutter button 16 has at its free front end a plug-in sleeve 22 running out in a circumferential latching nose 24, for example, via the embodiment represented in FIGS. 1 to 3 of the shutter button 16 inserted in the housing 1 wherein its plug-in part 22 and the latching nose 24 are attached within the cartridge 4 via a latching composite, wherein the latching nose 24, for example, engages with a circumferential locking groove 26 formed in the inner wall of the cartridge (see, FIG. 1, for example). Using this latching composite, the shutter button is specified at the dosing dispenser.

Figure 10:
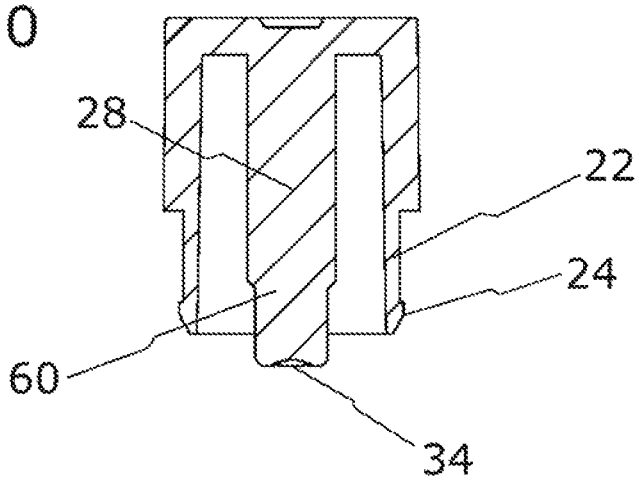
FIG. 10 a sectional view of the shutter button of FIG. 9*b;*
Figure 11:
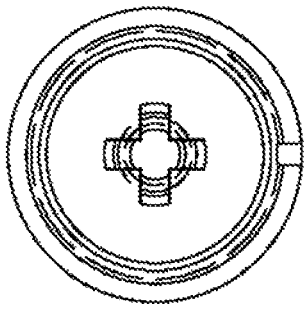
FIG. 11 a plane view onto the shutter button.
Figure 12:
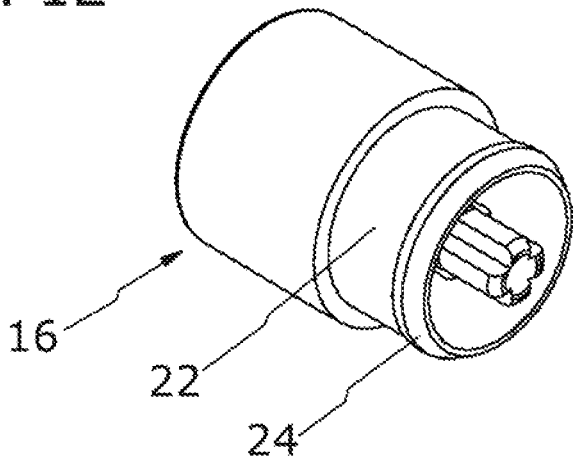
FIG. 12 a perspective representation of the shutter button.

In the central region the shutter button 16 has an elongated punch 28 inserted into a piston sleeve 30 at the rear side of the piston 12. A locking ball 32 arranged in the piston sleeve 30 abuts at the punch 28, for which the punch may be provided with a spherical cap-shaped indentation 34 at its free front, as can be seen best from FIG. 10. Thereby, a centering and guiding of the locking ball results which facilitates the sliding the piston sleeve on the punch 28 for the formation of the assembly unit 20.

Figure 8:
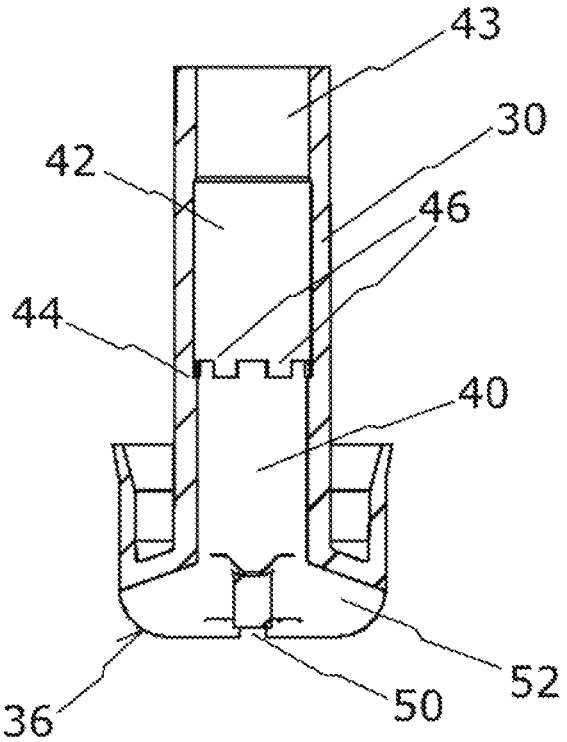
FIG. 8 a sectional view along line C-C of the piston in FIG. 7.

At the end of the piston 12 far from the punch 28, the piston is provided with a cap-shaped piston head 36 as is revealed best in FIG. 8. In the embodiment shown, the piston 12, preferably integrally produced by injection molding of plastic, has at its piston sleeve 30 longitudinal portions with slightly different inner diameters, i.e. a first longitudinal portion 40 and an adjoining second longitudinal portion 42, where the longitudinal portion 40 at the distal end of the shutter button 16 represents a slightly smaller diameter and thereby a narrowing against the longitudinal portion 42, where in the embodiment shown the transition region 44 is suitably formed by a conical transition shoulder having radial through slots 46 in the shoulder area for the formation of air discharge channels. Here, this is an appropriate measure but not a necessary one. The locking ball 32 is guided within the piston sleeve 30 and is fitted to the piston sleeve 30 according to the diameter.

As can be seen from FIG. 8, a (third) longitudinal portion 43 operatively connects to the piston sleeve 30, which provides the friction fit, which determines that a relative displacement between the punch 28 of the shutter button 16 and the piston sleeve 30. Here, the relative displacement between the punch 28 and the piston sleeve 30 takes place only if a corresponding friction force between the piston head 36 and the inner wall of the cartridge 4 is overcome. The friction force between the piston head 36 and the inner wall of the cartridge 4 should not be too high to block the motion of the punch within the sleeve. An advantageous range for the friction force to be adjusted would be RK for friction force, measured in Newton, divided by the piston surface, defined by the piston diameter and measured in $cm^2$, where this ratio should be in the range of 1 to 5, preferably in the range of 1 to 3. Here, the setting can be adjusted by appropriate material selection, surface finish, i.e., roughness, diameter ratios and the like. In that regard, the dimension of the interior diameter of the sleeve 30 is smaller in the third longitudinal portion 43 than the diameters of the two directly adjoining longitudinal portions 42 and 40.

In the drawings the dispenser is formed pin-like meaning that the pin essentially has an exterior diameter in the range of about 10 to 20 mm. However, for other applications larger diameters are also possible, where in practice dispensers with a diameter of 10 up to about 40 mm have also been found to be appropriate using the system described here. Nevertheless, this information is in no way to be regarded as limiting.

In the embodiment shown, the first longitudinal portion 40, remotely arranged from the shutter button 16, forms a constriction against the second longitudinal portion 42 and has a slightly smaller diameter. With respect to the locking ball 32, the interior diameter of the first longitudinal portion 40 is dimensioned in such a way that the ball takes in all positions over the first longitudinal portion 40 a sealing position such that neither material nor air can pass the locking ball. Appropriately, the first longitudinal portion is created with respect to the internal dimension of the cartridge sleeve and the diameter of the locking ball to an undersize, preferably to an undersize of 0.05 mm to 0.2 mm, whereas the second longitudinal portion 42 is created to an oversize, in particular such of 0.03 mm to 0.1 mm. This is convenient for the operation of the assembly unit 20 yet to be described later.

Figure 7:
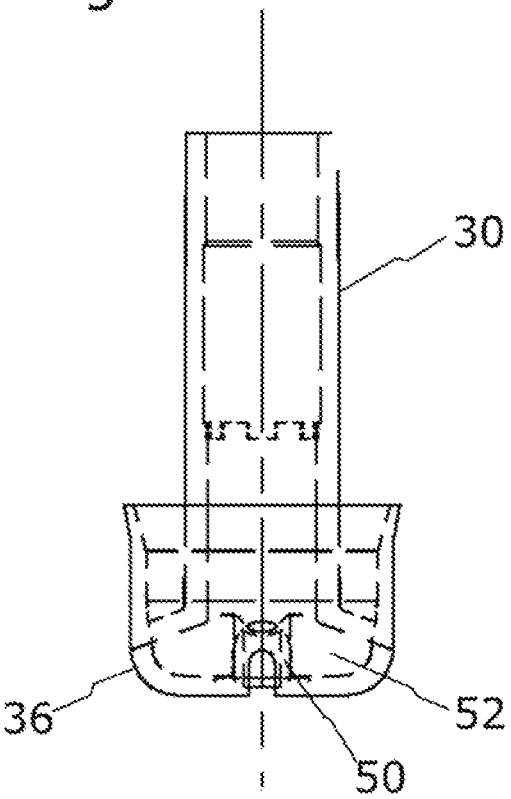
FIG. 7 a side view of the piston.
Figure 9A:
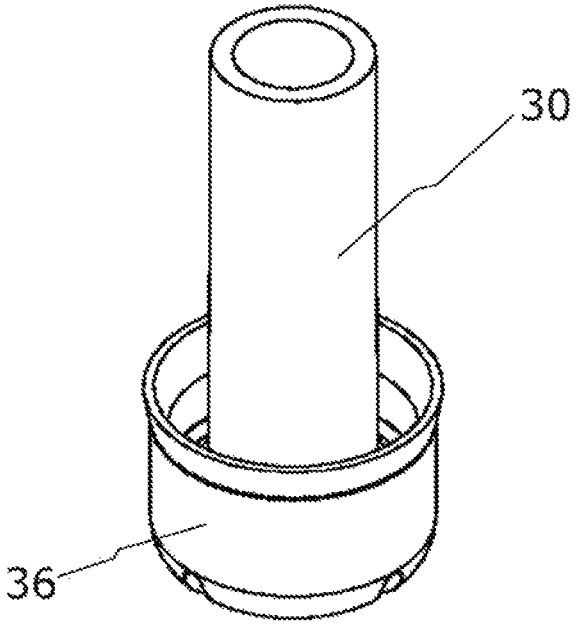
FIG. 9*a* a perspective view of the piston.
Figure 9B:
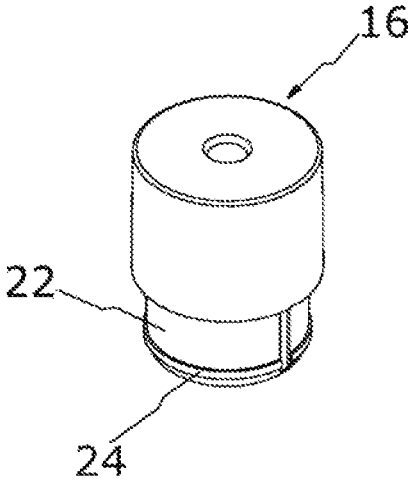
FIG. 9*b* a perspective view of the shutter button.

As can be learned from FIGS. 5, 7 and 9, the piston is equipped at its end face, i.e. distal from the shutter button 16, with a cap-shaped piston head 36 through which the piston is guided in the cartridge. A central opening 50 is provided centrally in the piston head 36, seen best in FIG. 7, which is somewhat smaller than the diameter of the locking ball. It is convenient here, that this central opening 50 of the head 36 is bridged with radial webs, in particular two cross-like arranged radial webs, such that removal of the locking ball from the end position within the cap 36 is ruled out.

Furthermore, several radial slots 52, here in particular four, are preferably provided at the peripheral edge of the cap-shaped piston head 36 that are arranged over the periphery and are distributed, therefore, with angular section from each other. Through these radial slots, forming channels, air can also be discharged from the cartridge as will be described in more detail below.

Figure 6:
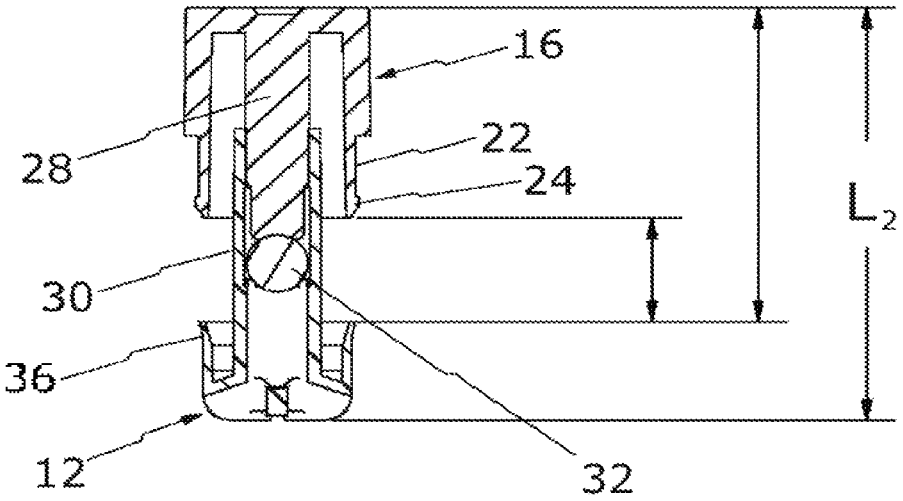
FIG. 6 a sectional view along line A-A of FIG. 4.

In FIGS. 4 to 6 the assembly unit 20 is represented in the position with disengaged piston 12, in which the assembly unit 20 is introduced into the cartridge after filling of the cartridge. With the introduction of the assembly unit 20 into the cartridge, the cap-shaped piston head 36 runs along the inner wall of the cartridge. At the same time, a relative displacement between the punch 28 of the shutter button 16 and the piston sleeve 30 is also possible when the assembly unit is introduced in the cartridge by pressing on the shutter button 16. Accordingly, it is within the scope of the invention to adjust the friction fit between piston head 36 and inner wall of the cartridge 4 to a smaller coefficient of friction than the friction fit between piston sleeve 30 and the punch 28 of the shutter button 16 inserted therein. That is, when the assembly unit 20 is introduced into the cartridge it remains in the position apparent from FIGS. 4 to 6 with correspondingly advanced piston head 36. If the front face of the piston head 36 abuts at the lower end of the material column within the cartridge, a stop of the insertion movement of the piston head 36 takes place and the relative displacement between punch 28 and piston sleeve 30 is started with further pressing on the shutter button 16. As a result, the locking ball 32 guided at the free end of the punch 28 from an initial mounting position located ahead of the transition region 44, which is shown in FIG. 6, to the narrower first longitudinal portion 40 until the shutter button 16 reaches its rest position at the cartridge. When the shutter button 16 reaches its rest position in the cartridge, the projecting noses 24 at the plug-in sleeve 22 engage with the annular groove 26 provided on the inside of the cartridge.

Depending on the filling state of the material in the cartridge, the locking ball is then in different positions as can be seen best from the description of the other figures.

Figure 13:
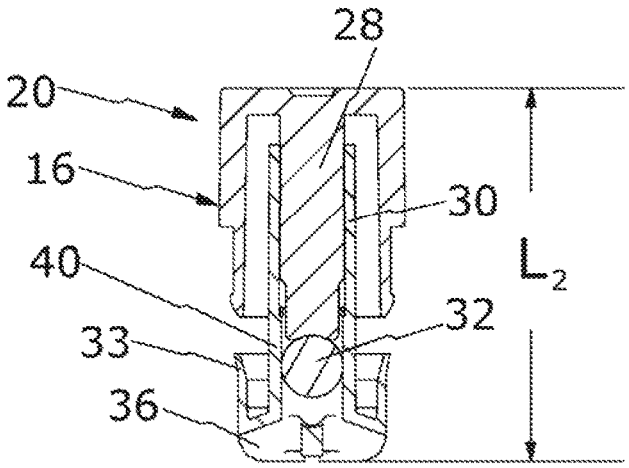
FIG. 13 a sectional view through the assembly unit with an end position of the piston at a mean filling amount in the cartridge.

In FIG. 13, showing the sectional view through the assembly unit 20, the locking ball 32 is in a position moved away from the transition region 44 in the first longitudinal portion 40, namely approximately in the center area of the longitudinal portion 40. In this state, which corresponds to a mean filling of the cartridge 4, the shutter button 16 is inserted or settled, respectively, in the cartridge via its projecting noses in the closed position, and the locking ball 32 is in sealing position. In this position as well, the locking ball does not let pass any air and the locking ball forms a block against leakage of the pasty or viscous material located in the cartridge 4.

Figure 14:
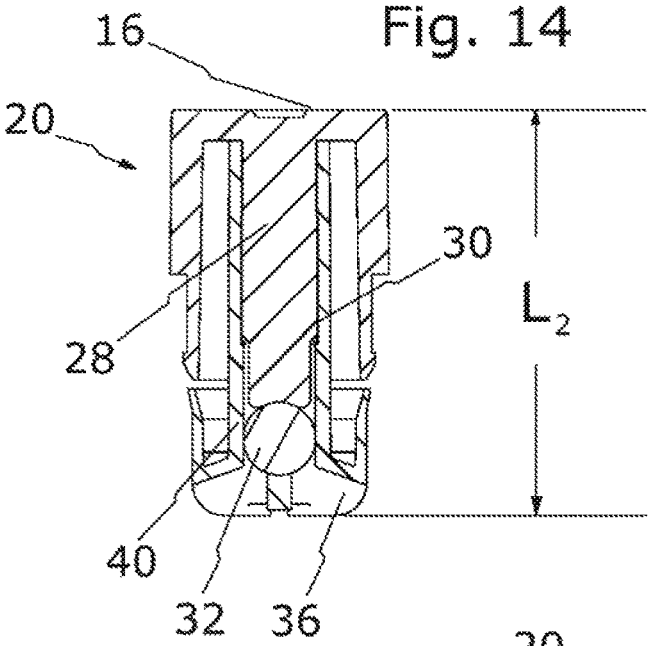
FIG. 14 a corresponding sectional view of the assembly unit at maximum filling of the cartridge.

FIG. 14 shows the assembly unit 20 in its end position during insertion into the cartridge when filling with maximum filling volume within the cartridge 4, where the locking ball 32 is located at the head-side end or in the range of the head-side end of the piston sleeve 30, respectively, corresponding to FIG. 14, namely in the end region of the first longitudinal portion 40.

Figure 15:
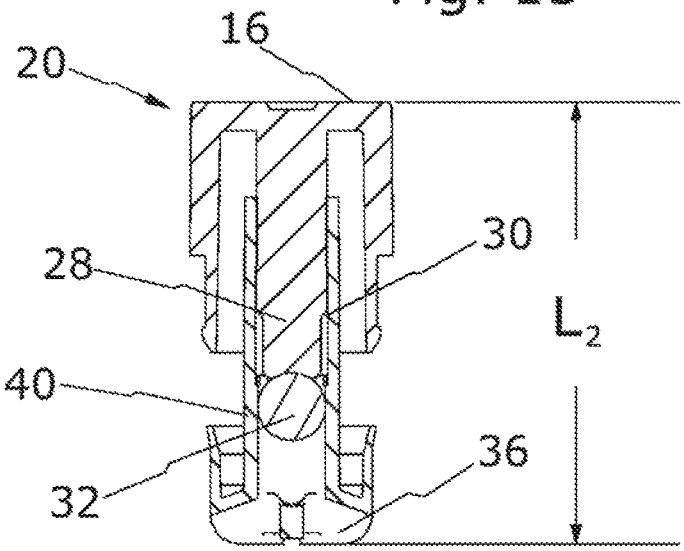
FIG. 15 a corresponding sectional view of the assembly unit in the event that a mean filling volume is achieved in the cartridge despite prescribed filling quantity.

FIG. 15 shows a position of the assembly unit in end position, i.e., when the filling takes place with a lower filling volume within the cartridge 4. In this state the piston head 36 is yet further advanced outwardly against the functional positions of FIGS. 13 and 14. However, the locking ball 32 is located now in the end region of the first longitudinal portion 40, i.e., behind the transition region 44, and therewith in sealing position. The positions of the assembly unit 20 in end position of the assembly unit within the cartridge, in which the shutter button 16 is engaged in the cartridge, correspond to the representations in FIGS. 1 to 3 in such a way that FIG. 1 with L1 for a prescribed filling quantity in the cartridge 4 represents a mean filling volume and here the position of the assembly unit 20 corresponds to the central position according to FIG. 13, the position of FIG. 2 for the maximum filling amount corresponds to the position according to FIG. 14, and the position for the minimum filling amount according to FIG. 3 to the position according to FIG. 15. That is, in the representation according to FIG. 3, the head is moved axially the farthest upward toward the applicator, in the position according to FIG. 1 approximately in a central position and in the position according to FIG. 2 the least far advanced from the shutter button 16.

Here, the filling of the cartridge is carried out via a known filling head in each case with the same given amount, although despite specifying and adjusting, this amount varies for different reasons between two limits of minimum filling amount to maximum filling amount and the dimension of the assembly unit 20 is designed to this variation range. In a concrete example, due to the non-avoidable variations of the filling amount filled into the cartridge 4, a material column having a height L1 of 45.85 mm may result (see FIG. 3) with the consequence that the distance between bottom of the shutter button 16 and end face of the piston 12 is then of the magnitude L2 of 22.91 mm. However, in case of corresponding variation it is possible, despite a prescribed filling amount adjustment, that a maximum filling amount column within the cartridge 4 with L1 in height of 49.25 mm (FIG. 2) results, with the consequence that the magnitude L2 according to FIG. 14 is adapted to 19.51 mm, which means that the head 26 is the least advanced in its final position in abutment at the lower end of the material column within the cartridge 4. In case of a mean filling amount according to FIG. 1, here for example L1 of 47.55 mm, the distance L2 between bottom of the shutter bottom 16 and the end face of the piston 12 would be 21.21 mm, which means that in this position the locking ball 32 is indeed still located in the constriction in the first longitudinal portion 40 and thereby in sealing position, but in this position the head 36 of the piston would be farthest advanced in order to come into abutment at the lower end of the filling column.

In this regard the unit can be inserted into the cartridge with the prefabricated assembly unit quasi in one grip and thereby in one workstation, wherein in a pressure movement the piston head 36 comes in abutment at the lower end of the material column within the cartridge and only then, with stopping of the further movement of the piston, this is traveled over by the relative motion of the shutter button, until it comes into its final rest position within the cartridge. In this way, independent of the respective filling state, after completed filling operation using one and the same assembly unit, the piston can be transferred in only one operation into its sealing position, where the displaced air can always escape via the passages downward in the direction of the shutter button. Here, the cap-shaped design of the piston head with rounded peripheral edge and slots incorporated therein for the formation of lead-through channels has the advantage that when the central region of the piston gets to the lower end of the material column within the cartridge and thereby the material column closes the central opening, air remaining there can still be discharged via the peripheral slots. This makes it possible to make the lower end of the material column within the cartridge after the filling completely free of air such that damages of the material accommodated into the cartridge due to oxidation and the like are excluded.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A system having a dosing dispenser for dispensing of pasty or viscous material, comprising:

an elongated housing a cartridge adapted to accommodate a column of viscous material slidingly engaged within the housing;

an applicator disposed at one end of the housing configured for material discharge;

a pump unit disposed between the cartridge and the applicator;

an actuator associated with the housing and configured to execute a pump stroke by displacing the cartridge;

a shutter button closing a housing end opposite the applicator;

a piston insertable into the cartridge, wherein the piston has a front face configured to abut against an end of the column of viscous material that is opposite the pump unit;

wherein the shutter button is comprised of an end with a substantially cylindrical wall extending therefrom that defines an interior cavity and a central punch extending from the end, wherein a portion of the central punch is located in the interior cavity, wherein the central punch is interconnected to a piston sleeve of the piston, and wherein a coefficient of friction between the piston and the inner wall of the cartridge less than a coefficient of friction between the piston sleeve and the punch of the shutter button; and wherein the piston is operatively interconnected to the shutter button such that the piston axially projects from the shutter button when inserted into the cartridge, wherein when the piston abuts the column of viscous material, which ceases further insertion of the piston into the cartridge, the shutter button can be pushed further onto the piston up to a rest position in the cartridge, in which a locking ball disposed between the front face of the piston and the shutter button is located in a sealing position.

2. The system according to claim 1, wherein the piston sleeve provides a sealing portion for the locking ball in a portion of the piston sleeve spaced from the shutter button, in which the locking ball blocks material passage from the cartridge but also blocks air passage.

3. The system according to claim 2, wherein piston sleeve comprises a first longitudinal portion having a first sleeve diameter interconnected to the piston and a second longitudinal portion interconnected to the first longitudinal portion, wherein the second longitudinal portion has a second sleeve diameter that is greater than the first sleeve diameter.

4. The system according to claim 3, further comprising a third longitudinal portion having a third sleeve diameter, which is less than the first sleeve diameter, interconnected to the second longitudinal portion, the third sleeve diameter having a ratio of friction force RK in Newton to the effective piston area in $cm^2$ in the range of 1 to 5.

5. The system according to claim 2, wherein the piston sleeve is hollow and cylindrical having a first interior diameter that is less than the diameter of the locking ball, and a second interior diameter that is greater than the first interior diameter.

6. The system according to claim 2, wherein the piston sleeve is substantially hollow with an interior surface that includes a conical transition region that separates first and second longitudinal portions, wherein channels are provided in the transition portion for an air passage.

7. The system according to claim 1, wherein the piston sleeve has a cylindrical cross-section, and the punch has an end portion facing away from the shutter button with a cross-sectional profile comprised of radial webs that define passage channels.

8. The system according to claim 1, wherein the front face of the piston has a central opening configured for air passage to the piston sleeve, wherein the piston further comprises a portion extending from the front face that extends toward the piston sleeve and overlaps a portion of the piston sleeve.

9. The system according to claim 8, wherein the central opening is bridged by webs.

10. The system according to claim 8, wherein the piston head is rounded at its peripheral edge and is formed in this area with radial slots for an air passage to the piston sleeve.

11. The system according to claim 8, wherein the portion extending from the front face that extends toward the piston sleeve has an edge facing the shutter button that defines a circumferential sealing lip configured to operatively engage an inner wall of the cartridge.

12. The system according to claim 1, wherein the central punch of the shutter button has at its free end a longitudinal portion with reduced diameter.

13. The system according to claim 1, wherein a free end of the central punch has a spherical cap-shaped indentation.

14. The system according to claim 1, wherein the locking ball is made of material with a stiffness greater than the material of the piston sleeve.

15. A pre-assembled assembly unit for the use in a system or a dosing dispenser according to claim 1, wherein the assembly unit is formed from a shutter button with a punch inserted into a piston sleeve of a piston, where a locking ball is arranged between punch and piston within the piston sleeve.

16. The system according to claim 1, wherein the actuator is a slide laterally disposed at the housing or a push button disposed at a second end of the housing.

17. The system according to claim 1, wherein relative motion between the piston sleeve and the punch of the shutter button is prevented until the front face of the piston abuts against an end of the column of viscous material.

18. A system having a dosing dispenser for dispensing of pasty or viscous material, comprising:

an elongated housing a cartridge adapted to accommodate a column of viscous material operatively engaged within the housing;

an applicator disposed at one end of the housing;

a pump unit disposed between the cartridge and the applicator;

an actuator associated with the housing and configured to execute a pump stroke by displacing the cartridge;

a shutter button closing a housing end opposite the applicator;

a piston insertable into the cartridge, wherein the piston has a front face configured to abut against an end of the column of viscous material that is opposite the pump unit; and wherein the shutter button is comprised of an end with a substantially cylindrical wall extending therefrom that defines an interior cavity and a central punch extending from the end, wherein a portion of the central punch is located in the interior cavity, wherein the central punch is operatively interconnected to a piston sleeve of the piston, and wherein a coefficient of friction between the piston and the inner wall of the cartridge less than a coefficient of friction between the piston sleeve and the punch of the shutter button.

19. The system according to claim 18, wherein the actuator is a slide laterally disposed at the housing.

20. The system according to claim 18, wherein relative motion between the piston sleeve and the punch of the shutter button is prevented until the front face of the piston abuts against an end of the column of viscous material.

* * * * *